US007111626B2

(12) United States Patent
Schmehl et al.

(10) Patent No.: US 7,111,626 B2
(45) Date of Patent: Sep. 26, 2006

(54) EQUINE INHALATION MASK

(75) Inventors: Thomas Schmehl, Giessen (DE); Tobias Gessler, Wettenberg (DE); Kerstin Fey, Giessen (DE)

(73) Assignee: TransMIT Gesellschaft fur Technologietransfer mbH, Giessen (DE)

( * ) Notice: Subject to any disclaimer, the term of this patent is extended or adjusted under 35 U.S.C. 154(b) by 0 days.

(21) Appl. No.: 10/478,380

(22) PCT Filed: May 23, 2003

(86) PCT No.: PCT/DE02/01874
§ 371 (c)(1),
(2), (4) Date: Jun. 18, 2004

(87) PCT Pub. No.: WO02/094122

PCT Pub. Date: Nov. 28, 2002

(65) Prior Publication Data

US 2004/0231672 A1 Nov. 25, 2004

(30) Foreign Application Priority Data

May 25, 2001 (DE) ..... 101 25 564

(51) Int. Cl.
*A62B 18/02* (2006.01)

(52) U.S. Cl. ..... 128/206.21; 128/206.12; 128/200.23; 128/206.18; 128/206.24

(58) Field of Classification Search ..... 128/200.24, 128/203.16, 203.17, 203.26, 203.27, 203.12, 128/204.17, 399, 400, 402, 200.27, 201.12, 128/201.13, 201.18, 201.23, 201.25, 202.15, 128/202.16, 202.17, 203.22, 203.29, 204.12, 128/205.12, 205.19, 205.25, 205.27, 206.12, 128/206.16, 206.21, 206.22, 206.24, 206.27, 128/207.11, 201.28, 205.24, 206.15, 107.16
See application file for complete search history.

(56) References Cited

U.S. PATENT DOCUMENTS

| | | | | | |
|---|---|---|---|---|---|
| 3,915,165 | A | * | 10/1975 | Rambosek et al. | 128/203.15 |
| 4,002,167 | A | * | 1/1977 | Rambosek | 128/206.24 |
| 4,143,658 | A | | 3/1979 | Rambosek et al. | |
| 4,546,768 | A | * | 10/1985 | Ferierabend | 128/200.16 |
| 4,953,546 | A | * | 9/1990 | Blackmer et al. | 128/203.16 |
| 5,062,423 | A | * | 11/1991 | Matson et al. | 128/207.15 |
| 5,666,948 | A | * | 9/1997 | Matson | 128/200.23 |
| 5,954,049 | A | | 9/1999 | Foley et al. | |

* cited by examiner

*Primary Examiner*—Henry Bennett
*Assistant Examiner*—Shumaya B. Ali
(74) *Attorney, Agent, or Firm*—Clark & Brody

(57) ABSTRACT

The invention relates to an equine inhalation mask, comprising at least one valveless combined inhalation and exhalation conduit, into which inhalant sources comprising respiration control elements and an energy supply that does not require supply lines are interchangeably integrated. A filter system is mounted on the outer end of the inhalation and exhalation conduit facing away from the head of the horse. Said system and the fact that the mask is effectively sealed when on the head of the horse prevent any escape of the aerosol into the environment, thus permitting a reliable inhalation therapy lasting several minutes under normal respiratory conditions.

27 Claims, 5 Drawing Sheets

EQUINE INHALATION MASK

STATE OF THE ART

The present invention relates to the technical field of the devices that affect the respiratory system of horses by introducing substances into the respiratory system. It has been known here for some years that the deposition of active substances in the lung by inhalation, when compared to oral administration or injection, provides a better efficiency and an important reduction of the dose rate and avoids undesirable side effects. With respiratory tract diseases occurring prevalently in horses, an effective inhalation therapy may help to avert economic losses. Such devices for horses are already known for a while, with different approaches having been pursued.

U.S. Pat. Nos. 3,915,165 and 4,143,658 describe intratracheal injection systems for the administration of dry medicaments in a gaseous suspension. U.S. Pat. No. 5,062,423 provides for the administration of aerosols the use of an endotracheal-like nasal tube to be inserted into the nasal-pharyngeal cavity of horses, whereas U.S. Pat. No. 5,666,948 proposes a device which is more easily insertable into the anterior nasal cavity of horses. Due to their invasivity, the use of the proposed devices puts high demands on the horse owner or user.

In an attempt to facilitate the administration, some patent applications propose devices called inhalation masks. By way of example, U.S. Pat. No. 5,954,049 of Trudell Medical Limited, Canada, describes an equine mask with MDI adapter comprising a source for providing aerosols of medication and an aerosolization chamber with an inlet valve and an outlet valve. The actual advantage of the mask resides in the fact that the mask is sized and adapted to conform to the forward portion of a horse's head, and that therefore no invasive measures for the aerosol administration are required. The proposed mask preferably comprises an inhalation conduit and at least one exhalation conduit separated from the latter, with each conduit possibly being provided with valves permitting exhalation exclusively through the respective conduit and inhalation exclusively through the aerosolization chamber.

The medication is often supplied by a jet nebulizer operated by a compressor. In this case, the aerosols of medication are conducted to the inhalation ports of the masks by means of tubes. Alternatively, dosing aerosols (so-called Metered Dose Inhalers, MDIs) may be used for some types of medication, with the user depressing a push-button to time the discharge of the medication to coincide with the inhalation of the horse. Pre-chambers (so-called spacers) to be mounted onto the inhalation mask have been developed to allow for the administration of a dose of medication sufficient for horses. Likewise, the discharge of medication from the spacer has to be adapted to the inhalation by observation of the horse on the part of the user.

DISADVANTAGES OF THE STATE OF THE ART

The disadvantages of the state of the art result among others from the lack of acceptance of the devices on the part of the horses or users.

In particular the insertion of probes or the like into the nostrils is very uncomfortable for horses and therefore difficult for the user, particularly since most of the animals will tend to refuse rather than accept them.

Another disadvantage for the horses is the restricted freedom of movement due to the tube-based supply of medication. Unless specific tying means are available, the user permanently has to keep the head of the horse and the supply line in position. Most horses are very irritated by the loud and irregular sounds, respectively, produced by compressors and especially by MDIs. In particular with MDIs it might happen that the user discharges the medication when a horse starts to inhale, and the horse, however, does not complete the inhalation process due to the unfamiliar fizzling sound produced during the discharge of the medication, so that at worst, the deposition of the medication targeted to the lung is inhibited. The aforementioned inconveniences result in an insufficient deposition of the mostly expensive medications in the lungs of the horses.

The inhalation mask described in U.S. Pat. No. 5,954,049 provides expiration and/or inspiration valves to permit a proper air flow through the mask. However, such valves increase the breathing resistance, in particular when covered by exhaled air condensate. In the event that such valves are located in the inspiratory branch of the mask between the aerosol-generating device and the nostrils of the horse, the aerosol particles may deposit there, thus not being available for inhalation anymore. This results in a reduced efficiency of the system and a loss of medication.

Furthermore, the medications, having strong impacts on human beings likewise, find their way through the exhalation conduits and leaks in the mask into the inhaled air of the user, thus presenting important health hazards. The hitherto proposed devices and inhalation masks do not provide any means to filter the expiration air partially loaded with medications. Generally, the administration of inhaled medication to horses requires the supervision and presence of a user who is exposed to the medication containing aerosols that have escaped into the ambient air. In particular when MDIs are used, it is imperative that the users do not leave the stable during the discharge of the medication, since they must time the discharge of the medication to coincide with the inhalation of the horse.

OBJECT OF THE PRESENT INVENTION

It is an object of the present invention to provide an equine inhalation mask both comprising a filter system for the expiration air, an optimised sealing of the mask with the head of the horse as well as valveless air passages and being economically and easy to handle.

HOW TO ACCOMPLISH THE OBJECT

The object is accomplished by an equine inhalation mask (1) having an oval, tapered cross section with a base side open and larger at the outer end facing towards the head of the horse, and a smaller, closed base side, characterized in that said inhalation mask comprises one or more of the following means, namely

- at least one combined inhalation/exhalation conduit,
- a distribution conduit in the event that but a single inhalation/exhalation conduit exists to direct the inhaled air to both nostrils of the horse,
- an inhalant source which is at least partially integrated into each of the at least one inhalation/exhalation conduits with integrated respiration control elements, preferably piezoelectric nebulizers or other aerosol generating devices that do not require supply lines,
- filter means and filter retainer, mounted in front of the inhalant source in the direction of the inspiratory airflow, a means for collecting/evacuating saliva, mounted on the smaller, closed base side, a mask sealing ring, at least two mask fasteners, a mask sealing hose.

The oval, tapered, bucket-type inhalation mask with a base side open and larger at the outer end facing towards the head of the horse, and a smaller, closed base side is characterized according to the present invention in that it is made of a flexible but substantially rigid material, e.g. plastic, and is preferably transparent and/or its inner wall comprises according to the present invention a roughened section that covers the entire inner diameter over a length of at least 10 cm extending from the edge proximate to the head of the horse towards the smaller base side.

The at least one combined inlet/outlet conduit is characterized according to the present invention in that the free flow has the greatest possible cross-section over the entire length of the conduit, with a minimum dimension of 4 $cm^2$, it is mounted at the same height with the nostrils, it is permanently attached to or repeatedly detachable from the inhalation mask, it comprises an integrated support suited to receive interchangeable inhalant sources, and an interchangeable filter means is mounted on the opening of the conduit facing towards the outside air, in or in front of the opening of the conduit, said filter means being removably attachable to the wall of the conduit by a filter retainer and covering the entire free opening of the conduit.

In another embodiment, a filter retainer with an interchangeable filter membrane or an expendable filter may be mounted in front of the opening of the conduit that faces towards the outside air, with the surface of the filter membrane preferably being larger than the cross section surface of the inlet/outlet conduit to keep the flow resistance during inspiration and expiration as low as possible.

The filter means used according to the present invention are preferably made of glass-fibre ceramic for mechanic filtration or polypropylene for electrostatic filtration of the exhaled air, thus serving to protect the human beings staying in vicinity of the inhaling horse. Furthermore, the filter material may be adapted and modified according to the physico-chemical characteristics of the used active substances and may consist, for instance, of activated carbon or coated activated carbon.

In a particularly preferred embodiment, two combined inlet/outlet conduits are mounted in the inhalation mask at the same height with the left and right nostril, in such manner that the aerosol-containing inhaled air is less likely to change its direction on its way from the aerosol generating device to the relevant nasal passageway, whereby aerosol losses due to impaction are prevented.

In the event that it is desired, for financial reasons, for better handling or for weight reduction, to provide the mask with one single inhalant source in total in combination with one inhalation/exhalation conduit, the invention provides the use of a distribution conduit for the airflow from the inhalation/exhalation conduit to the nostrils of the horse.

The distribution conduit of the present invention is characterized in that the cross section of the free flow amounts at any location in the branched flow path extending from the inhalation/exhalation conduit to the breathing ports of the mask, for the total of the conduits, to at least 4 $cm^2$, and that the individual branches of the distribution conduit are symmetric and terminate opposite the nostrils.

The inhalant sources integrated into the at least one combined inlet/outlet conduit generate an aerosol of medication respirable for the horse and are characterized in that they comprise integrated respiration control elements and an energy supply. In particular, piezoelectric nebulizers are proposed for use as inhalant sources according to the present invention, such as known, for instance, from EP 0 923 957 A1. Such inhalant sources may be designed as very small-dimensioned types, affording according to the invention to mount the inhalant source in the inhalation conduits of the mask. Furthermore, piezoelectric nebulizers distinguish by a negligible sound production during the discharge of aerosol, thus preventing to disturb the inhalation process of the horses. This type of nebulizer affords to administer the total dosage in a period of several minutes, thus allowing for a smooth breathing pattern.

Apart from piezoelectric nebulizers, other aerosol generating devices that do not require supply lines, comprising an integrated energy supply, may be mounted as inhalant source in the combined inlet/outlet conduit. Such aerosol generating devices are known, for instance, from the U.S. Pat. No. 5,662,271.

In conjunction with respiration control elements, likewise being integrated into the inhalation conduits or in the inhalant sources, one can renounce on providing an additional exhalation conduit and thus also on providing valves, subject to the condition that the conduits comprise appropriate filters and the inhalation conduits are sufficiently dimensioned. A particularly preferred valveless embodiment of the inhalation mask affords to reduce the breathing resistance experienced by the inhaling horse to a minimum and to prevent aerosol losses caused by undesired deposition on valves.

The proposed respiration control elements have the advantage that the user doesn't need to execute the discharge of the aerosol and the coordination between the discharge and the breathing pattern of the horse himself, and that the medication is discharged in an economical manner upon inspiration only.

As sensor means for the respiration control elements, it may be considered to use flow sensors illustrated in DE 199 42 675, e.g., or the pressure sensors described in WO 97/48431.

In the present case, simply two resistance thermometers might be mounted, staggered in the direction of the flow, e.g., staggered by the extension of the inhalant source, on or in the inhalant source, and adjusted by a Wheatstone bridge in order to transmit, upon inhalation, the signal for inhalant generation to the processor unit of the control system.

The means for collecting/evacuating saliva, mounted on the smaller, closed base side, is characterized in that it is situated in form of a bulge on the lower edge of the smaller base side facing towards the mouth of the horse, and designed to be repeatedly removable or openable, and made of an easily cleanable material, e.g., plastic, preferably transparent plastic to facilitate the level control.

The sealing ring according to the present invention is made of a flexible, reversibly deformable material, preferably of an airtight foamed material with a cleanable coating, and is roughened according to the present invention in the section of the outer portion of the surface.

In a further advantageous embodiment, the sealing ring according to the present invention is designed as soft hose, with at least quarter being filled with a gel-like, resilient substance.

Sealing rings of different sizes afford to adapt the mask in a wide range to different sizes of horse heads. Preferably, the inner diameter of the sealing ring may vary, whereas the outer diameter of the sealing ring must continue to accommodate the inner diameter of the inhalation mask without any modification.

The at least two mask fasteners are firmly attached to the outer surface of the inhalation mask, with a maximum distance of 20 cm from the edge of the larger, open base side of the mask. In a preferred embodiment, the fastening means are curved hooks, opening downwardly in the direction towards the smaller base side of the mask, and being oppositely situated on the sides of the mask. A lengthwise adjustable holding strap may be attached to these fasteners, running around the neck of the horse or being designed as the upper part of a horse halter. In another embodiment, one holding strap may be attached to each fastener respectively and detachably firmly connected with the horse halter to secure the inhalation mask to the head of the horse.

The mask sealing hose is made of an airtight, rubber-like, reversibly extensible material, is open on both sides, and comprises at least two metal-reinforced openings on one edge to insert the mask fasteners. In a further embodiment, the mask sealing hose abuts the outer wall of the inhalation mask in its entire diameter in the section of the base side open and larger at the outer end facing towards the head of the horse to form a firm junction. Due to its rubber-like elasticity, the free end of the sealing hose has a smaller opening diameter than the base side open and larger at the outer end facing towards the head of the horse.

According to the present invention, in the case of a separate sealing hose that is not firmly attached to the mask, the inhalation mask will be applied according to the following steps:

- first, the mask sealing hose will be put over the mouth of the horse, with the one end being positioned under the loosened lower strap of the horse halter. The lower part of the sealing hose will be turned up from the lower end to the point defined by the straps.
- thereafter, the mask sealing ring will be put over the mouth of the horse, with the lower part to the chin groove and the upper part over the bridge of the nose.
- then, the tapered inhalation mask will be positioned with its open end over the sealing ring, wedging thereby with the sealing ring due to the roughened surfaces on the inner wall of the mask or/and on the sealing ring.
- ultimately, the part of the mask sealing hose previously turned up will now be turned down, and the metal-reinforced openings of the sealing hose will be positioned over the mask fasteners. In the event that the openings reside too low or too high and do not align with the mask fasteners, and/or if no tensioning force has been built up by means of the sealing hose onto the fasteners and hence onto the mask, the sealing hose must be further pulled up and positioned under the strap of the horse halter or be pulled down, respectively, before tightening the straps over the sealing hose by means of the fastening means on the horse halter.

Once the metal-reinforced openings of the sealing hose have been aligned with the mask fasteners, they wedge together and the mask is secured to the head of the horse. As a precaution, the lengthwise adjustable holding strap will now be attached to them, allowing for an additional securing of the mask and the sealing hose in the neck of the horse.

In an advantageous embodiment of the present invention, the procedure for applying the mask consists in securing the straps of the horse halter directly under the mask fasteners and tightening them over the upper edge of the oval mask body, neglecting thereby the mask sealing hose. Hence, the oval mask body is pressed to the inner sealing ring by the tension of the strap.

In the case of a sealing hose that is firmly attached to the mask, the inhalation mask is to be applied according to the invention by following steps:

- First, the free end of the sealing hose of the mask is outwardly put over the inhalation mask in the direction towards the smaller base side.
- afterwards, the mask sealing ring is put over the mouth of the horse, with the lower part to the chin groove and the upper part over the bridge of the nose.
- then, the tapered inhalation mask is positioned with its open end over the sealing ring, wedging thereby with the sealing ring due to the roughened surfaces on the inner wall of the mask or/and on the sealing ring.
- ultimately, the part of the mask sealing hose previously turned down is turned up onto the head of the horse, and the inhalation mask is secured to the head of the horse by the mask fasteners via the holding straps or the halters.

The use of the inhalation mask of the present invention reduces or even solves a plurality of the hitherto known problems.

EXAMPLES

The invention and its advantageous embodiments are described in more detail by the following figures and examples, wherein:

FIG. 1 is a schematic side view of the head of a horse with the longitudinal section of the basic structure of the inhalation mask according to the invention, but laterally mounted inhalation/exhalation conduits being omitted, with means for collecting/evacuating saliva situated on the front side, with mask sealing ring, with mask fasteners situated on the upper and lower portion for the encompassing mask sealing hose.

FIG. **4*b*** is a schematic side view of an inhalation/exhalation conduit with a support for an inhalant source located on the inner wall of the inhalation/exhalation conduit and detachable extension and tapering means for the inhalation/exhalation conduit, also serving as filter retainer, for expanding the cross section of the flow in the section of the filter means.

Figure 5:
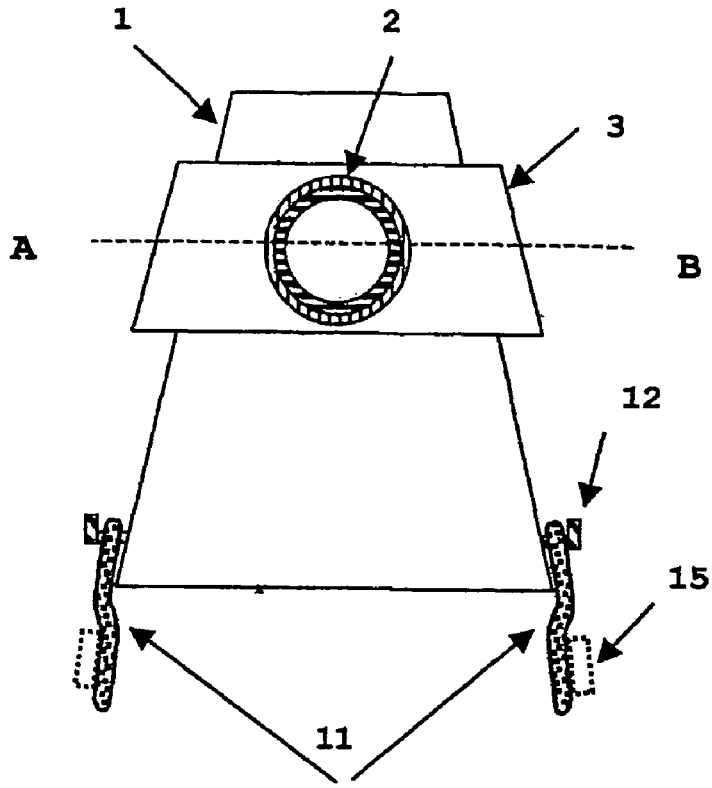

FIG. 5 is a schematic top view of an inhalation mask according to the present invention with portions being broken away, comprising one single inhalation/exhalation conduit on the upper side of the mask and a distribution conduit in the section of the nostrils. In contrast to FIG. 1, the mask fasteners are situated laterally, and, likewise the mask sealing hose and the horse halter, illustrated in a horizontal cross section view.

Figure 6:
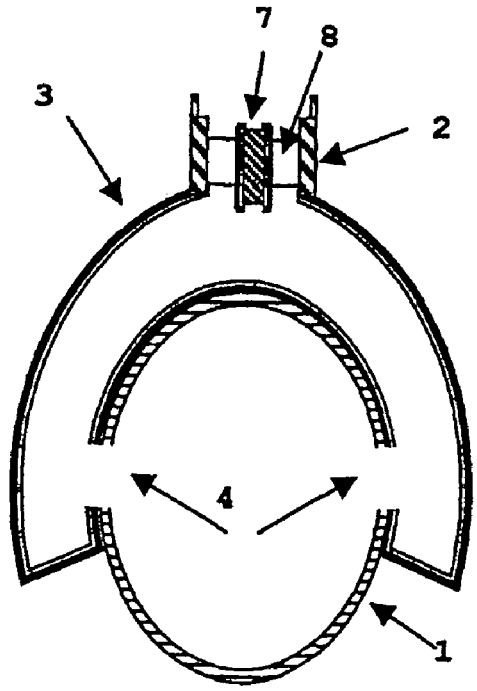

FIG. 6 is a vertical cross section through the inhalation mask as illustrated in FIG. 5 along the intersection line A-B with breathing ports of the mask, distribution conduit, inhalation/exhalation conduit and inhalant source integrated in the latter.

Figure 7:
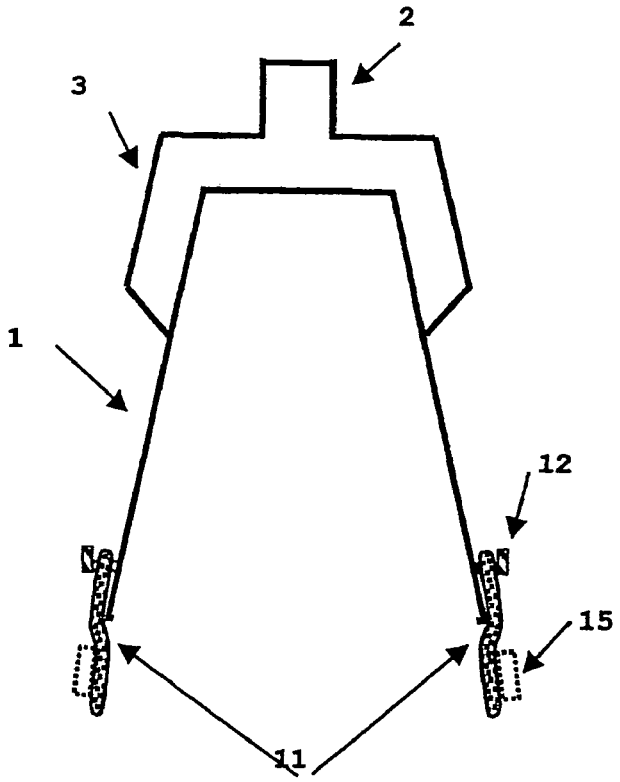

FIG. 7 is a top view of an inhalation mask according to the invention different from the previous embodiments in that the inhalation/exhalation conduit with integrated inhalant source is mounted on the front end of the mask and the distribution conduit directs the inhalation/exhalation air laterally from the front end of the mask to the nostrils and vice-versa, respectively.

Figure 8:
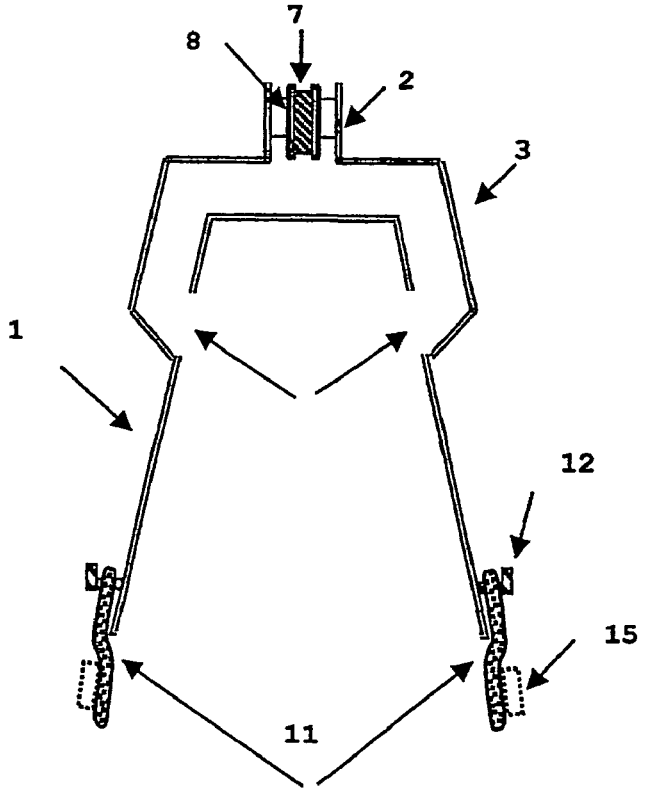

FIG. 8 is a horizontal cross section through the inhalation mask according to the invention as illustrated in FIG. 7 with the means inhalation/exhalation conduit comprising the inhalant source being mounted on the front end of the mask and the distribution conduit extending from the front end to the nostrils on the back end.

Figure 1:
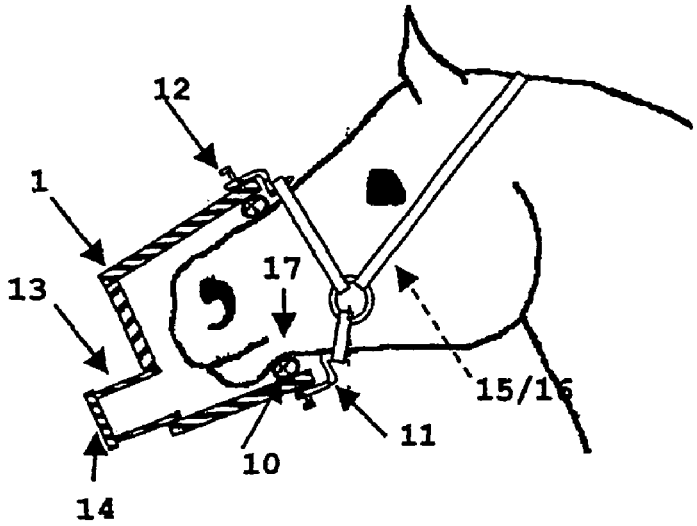

FIG. 1 elucidates the basic procedure to apply the inhalation mask in a schematic side view of the head of a horse with portions being broken away, showing the inhalation mask (1) according to the invention in a cross sectional view. The inhalation/exhalation conduits according to the present invention with integrated inhalant source and filter means are laterally mounted and therefore here not shown. Illustrated are, however, the means for collecting/evacuating saliva (13) on the front side, the mask sealing ring (10), mask fasteners (12) mounted on the upper and the lower portion for the encompassing mask sealing hose (11).

After having wedged with the sealing ring (10), the inhalation mask (1) is prevented by direct connection of the horse halter (15) with the fasteners (12) or by means of the mask sealing hose (11) from slipping off the head of the horse. The particular advantage resides in the fact that the sealing ring and/or the inner surface of the mask is roughened. For applying the inhalation mask, the sealing ring (10) will be put over the mouth and the nose of the horse to the chin groove and then secured by further pulling over the nose.

The mask is sealed with respect to the environment by the flexible ring and the extensible sealing hose or by the flexible ring and tightening the two lower parts of the halter. In the first case, the mask is pressed against the head of the horse, whereby the sealing ring is firmly pressed around the head of the horse, by the tensioning forces of the stretched sealing hose, and in the last case by the forces exercised by the tightened straps of the horse halter. Thanks to the use of halters, the horses are accustomed to such type of tension.

The use of inhalant sources with respiration control elements and low-noise piezoelectric nebulizers with integrated energy supply according to the present invention allows the user during long inhalation processes, such as often required for the therapy, to leave the horse in the stable without any supervision.

Figure 2:
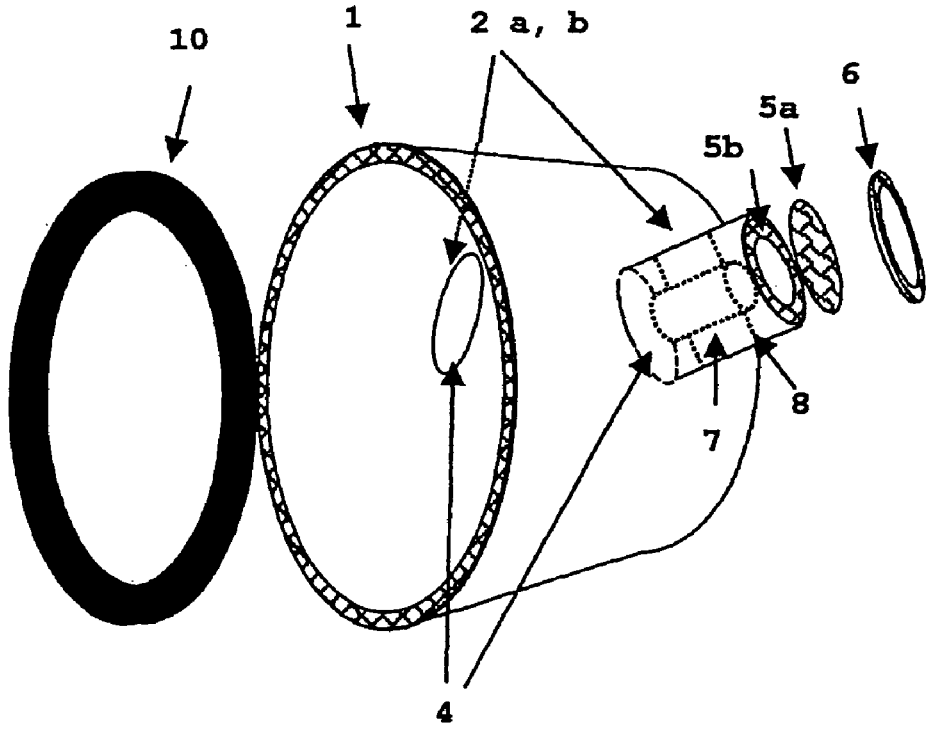
FIG. 2 is a schematic view of the inhalation mask with the mask opening facing towards the head and a mask sealing ring according to the invention in the front and two schematically suggested combined inhalation/exhalation conduits according to the present invention in the right-hand inhalation/exhalation conduit as well as a filter means and a filter retainer.

FIG. 2 shows a schematic view of the inhalation mask (1) with the mask opening facing towards the head and a sealing ring (10) in the front as well as two schematically suggested combined inhalation/exhalation conduits (2) with a schematically illustrated inhalant source (7) in the right-hand inhalation/exhalation conduit.

The two inhalation/exhalation conduits (2) are located at the same height with the nostrils. In the right-hand of the two inhalation/exhalation conduits (2*a, b*), a support means (8) serves to fix the inhalant source (7) for repeated attachment and detachment at the wall of the conduit (2*b*).

The attachment of the inhalant source is adapted according to the invention, for repeated removal in order to enable an integrated energy and inhalant supply. In this embodiment, the right-hand conduit, which here is an example for both inhalation/exhalation conduits, is covered by a filter means (5) secured by the filter retainer (6).

Figure 3:
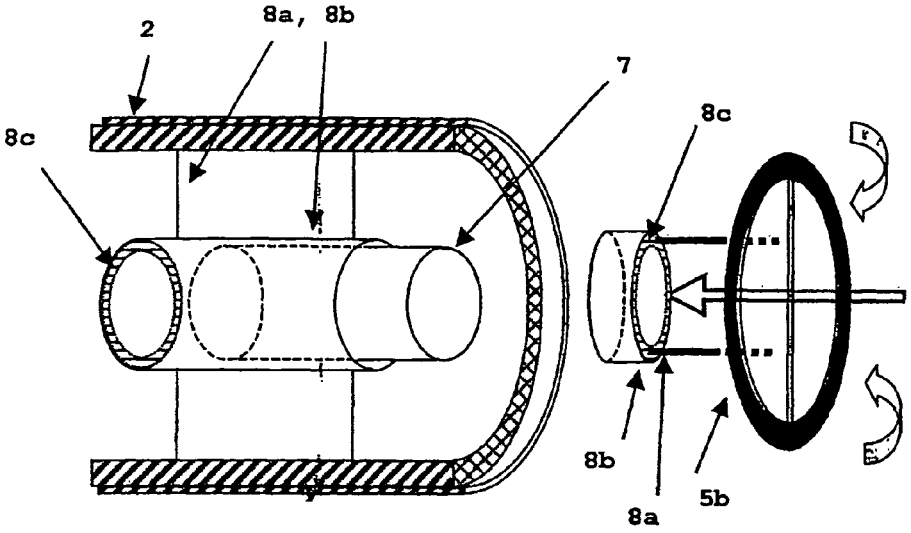
FIG. 3 is a schematic view of the inhalation/exhalation conduit, partially with portions being broken away, and a perspective view of the inhalant source of FIG. 2 with support of the inhalant source.

FIG. 3 shows a schematic view, partially with portions being broken away, of the inhalation/exhalation conduit (2) and the inhalant source (7) of FIG. 2 with a support means (8) for the inhalant source.

The cylindrical inhalant source illustrated here as an example may be repeatedly removably attached by, for instance, introducing the inhalant source in the one of two parts of a cylinder (8*b*) with fastening ring (8*c*) and then securing it by the second part of the cylinder and a fastening ring (8*c*) which is attached to the filter support ring (5*b*) by fastening bars (8*a*).

Figure 4:
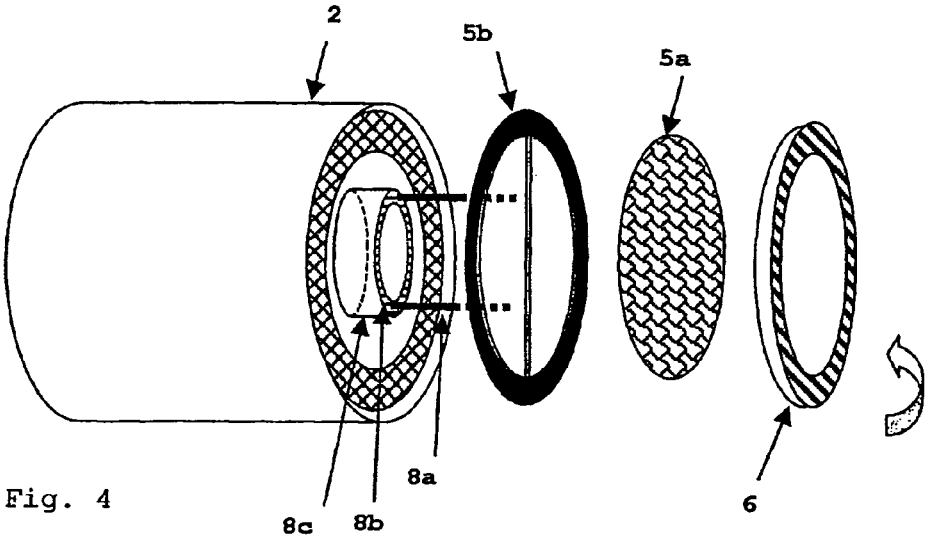
FIG. 4 is a schematic side view of the inhalation/exhalation conduit of FIG. 2 and FIG. 3 with filter means and filter retainer.

FIG. 4 shows a schematic side view of the inhalation/exhalation conduit of FIG. 2 and FIG. 3 with filter means (5*a, b*) and filter retainer (6). The final securing of the inhalant source (7, here not shown) in the inhalation/exhalation conduit (2) is made by integrating the filter support ring (5*b*) with fastening ring (8*b*), introducing a filter (5*a*) and, for example, screwing in a filter retainer (6).

Figure 4B:
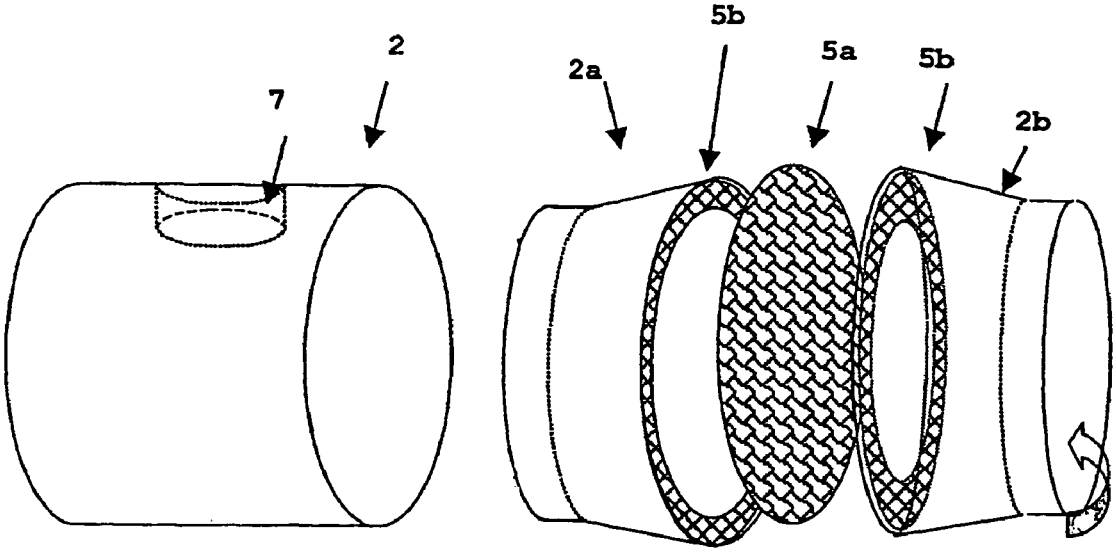

Similar to FIG. 4, FIG. 4*b* shows a schematic side view of an inhalation/exhalation conduit, illustrated here, however, with an inhalant source (7) with integrated respiration control elements which is mounted on the inner wall of the inhalation/exhalation conduit (2), and extension and tapering means (2*a, b*) which may be mounted on the conduit (2), also serving as filter retainer and expanding the cross section of the flow in the section of the filter means (5).

FIG. 5 shows a schematic top view of an inhalation mask according to the invention with portions being broken away, comprising a single inhalation/exhalation conduit (2) on the upper side of the mask and a distribution conduit (3) in the section of the nostrils. The use of one single inhalant source may be reasonable to reduce the costs and the maintenance efforts. In contrast to FIG. 1, the mask fasteners (12) are laterally mounted and like the mask sealing hose (11) and the horse halter (15) illustrated in a horizontal cross section view.

FIG. 6 shows a vertical cross section through the inhalation mask (1) according to FIG. 5 along the intersection line A-B with breathing ports (4) in the mask, distribution conduit (3), inhalation/exhalation conduit (2) on the upper side of the mask and inhalant source (7) integrated in the latter. Due to the high tidal volume of horses (up to 50–180 liters/minute), care must be taken with this advantageous embodiment to ensure that the inhalation/exhalation conduit as well as the distribution conduit are sufficiently dimensioned. A cross section of the free flow inferior to 4 $cm^2$ is to be avoided. Inhalation masks with smaller cross sections of flow will not be accepted by horses.

FIG. 7 shows a top view of a particularly advantageous embodiment of the inhalation mask (1) according to the invention, distinguishing from the previously described embodiments in that the inhalation/exhalation conduit (2)—comprising an integrated, here not visible inhalant source (7)—is mounted on the front end of the mask (1), and in that the distribution conduit directs the inhalation/exhalation air laterally from the front end of the mask to the nostrils and vice versa, respectively.

It is advantageous here that the means inhalant source and filter—which, as the case may be, are to be supervised—as well as the means for collecting/evacuating saliva (13), are located in the user's field of vision. Furthermore, the horse will experience less discomfort/restrictions of the field of vision with this embodiment.

FIG. 8 shows the horizontal cross section of the particularly advantageous embodiment of the inhalation mask according to the invention as described in FIG. 7, comprising the means inhalation/exhalation conduit (2) with inhalant source (7) mounted on the front end of the mask and the distribution conduit (3) extending from the front end to the nostrils on the back end.

Reference Signs

1 inhalation mask
2 inhalation/exhalation conduit
a) expansion/means
b) tapering means
3 distribution conduit
4 breathing ports of the mask
5 filter means
a) filter
b) filter support ring
6 filter retainer
7 inhalant source
8 support for the inhalant source
a) fastening bar
b) fastening cylinder
c) fastening ring
9 respiration control elements
10 mask sealing ring
11 mask sealing hose
12 mask fasteners
13 means for collecting/evacuating saliva
14 cover member for the saliva collecting means
15 horse halter
16 ordinary noseband
17 chin groove

The invention claimed is:

1. An equine inhalation mask sized and shaped for application to the nose portion of a horse's head, including fastening means for releasable fixation to a horse halter thereon, and including a support for an inhalant source flow-connected to at least one conduit, the mask comprising a housing of oval tapering cross section with a sealing ring at its upper end, wherein the at least one conduit is mounted at nostril level and is flow-connected with the mask interior for both inhalation and exhalation, wherein the housing is of flexible yet rigid material, the housing being generally conical with a larger base-side being open and a smaller base-side being closed, wherein the larger base-side includes a roughened inside portion and a sealing hose for applying an end of the upper mask to the horse's head, wherein a distribution conduit surrounds lateral breathing ports in a front end of the masks, and wherein the support is designed to exchangeably receive the inhalant source which is provided with respiration control elements.

2. The equine inhalation mask according to claim 1, wherein the roughened inside portion extends over at least 10 cm from an edge of the larger base-side.

3. The equine inhalation mask according to claim 1, wherein the at least one conduit is a combined inlet/outlet conduit.

4. The equine inhalation mask according to claim 1, wherein a filter is attached to an opening at an outer end of the at least one conduit facing away from the horse's head.

5. The equine inhalation mask according to claim 1, wherein an exchangeable filter is held in a filter retainer of the at least one conduit, the filter being interposed between an expansion means and a tapering means.

6. The equine inhalation mask according to claim 4, wherein the filter is removably attached to the wall of the at least one conduit so as to cover the entire free opening thereof.

7. The equine inhalation mask according to claim 4, wherein the filter is adapted for filtration of exhaled air, consisting of glass-fiber ceramic for mechanic filtration or of polypropylene for electrostatic filtration or of a physico-chemical filter material such as activated carbon.

8. The equine inhalation mask according to claim 1, wherein the sealing ring is made of a foamed material having an airtight cleanable coating and is roughened at an outer portion of its surface.

9. The equine inhalation mask according to claim 1, wherein the sealing ring is a soft hose of which at least one quarter is filled with a gel-like resilient substance.

10. The equine inhalation mask according to claim 1, wherein the sealing hose is made of an airtight rubber-like material and is open on both sides.

11. The equine inhalation mask according to claim 10, wherein one edge of the sealing hose includes at least two metal-reinforced openings for insertion of mask fasteners.

12. The equine inhalation mask according to claim 10, wherein one end of the sealing hose is attached to the larger base-side of the mask.

13. The equine inhalation mask according to claim 1, wherein mask fasteners are firmly attached to an outer surface of the mask at a maximum distance of 20 cm from an edge of the larger base-side.

14. The equine inhalation mask according to claim 1, wherein mask fasteners are designed as curved hooks opening downwardly towards the smaller base-side.

15. The equine inhalation mask according to claim 14, wherein the mask fasteners are oppositely situated in the region between the horse's nose and lower jaw.

16. The equine inhalation mask according to claim 1, wherein a saliva collecting and evacuating means of easily cleanable material is detachably fixed to the mask by way of a bulge arranged at the smaller base-side in front of the horse's mouth.

17. The equine inhalation mask according to claim 4, wherein the saliva collecting and evacuating means is transparent plastic for level control.

18. The equine inhalation mask according to claim 1, wherein the at least one conduit and the distribution conduit have cross sections of at least 4 $cm^2$ at any location up to the breathing ports.

19. The equine inhalation mask according to claim 1, wherein the distribution conduit includes symmetric branches terminating opposite the horse's nostrils.

20. The equine inhalation mask according to claim 1, wherein the inhalant source support is mounted to the housing.

21. The equine inhalation mask according to claim 16, wherein the filter is removably attached to the wall of the at least one conduit so as to cover the entire free opening thereof.

22. The equine inhalation mask according to claim 5, wherein the filter is adapted for filtration of exhaled air, consisting of glass-fiber ceramic for mechanic filtration or of polypropylene for electrostatic filtration or of a physico-chemical filter material such as activated carbon.

23. The equine inhalation mask according to claim 6, wherein the filter is adapted for filtration of exhaled air, consisting of glass-fiber ceramic for mechanic filtration or of polypropylene for electrostatic filtration or of a physico-chemical filter material such as activated carbon.

24. The equine inhalation mask according to claim 21, wherein the filter (5*a*) is adapted for filtration of exhaled air, consisting of glass-fiber ceramic for mechanic filtration or of polypropylene for electrostatic filtration or of a physico-chemical filter material such as activated carbon.

25. An equine inhalation mask sized and shaped for application to the nose portion of a horse's head, including fastening means for releasable fixation to a horse halter thereon, and including a support for an inhalant source flow-connected to at least one conduit, the mask comprising a housing of oval tapering cross section with a sealing ring at its upper end, wherein the at least one conduit is mounted at nostril level and flow-connected with an interior of the mask, a filter being attached to an opening at an outer end of the at least one conduit facing away from the horse's head, wherein the housing is of flexible yet rigid material, the housing being generally conical with a larger base-side being open and a smaller base-side being closed, wherein the larger base-side includes a roughened inside portion and a sealing hose for applying an end of the upper mask to the horse's head, wherein the support is designed to exchangeably receive the inhalant source which is provided with respiration control elements, and wherein the sealing ring, the sealing housing and the housing seal the interior of the mask such that the filtered opening in the at least one conduit creates a passage for air to be drawn into the interior through inhalation by the horse and for expiration air to exit the interior through the filtered opening.

26. The equine inhalation mask according to claim 25, wherein the at least one conduit is valve-less.

27. The equine inhalation mask according to claim 25, wherein the support is located within the at least one conduit, the filter being removable to allow for inhalant source exchange.

* * * * *

UNITED STATES PATENT AND TRADEMARK OFFICE

CERTIFICATE OF CORRECTION

PATENT NO. : 7,111,626 B2
APPLICATION NO. : 10/478380
DATED : September 26, 2006
INVENTOR(S) : Schmehl et al.

It is certified that error appears in the above-identified patent and that said Letters Patent is hereby corrected as shown below:

On The Title Page, Item (22)

"PCT Filed: May 23, 2003" should read --PCT Filed: May 23, 2002--

On The Title Page, Item (30)

Under Foreign Application Priority Data
"DE 101 25 564" should read --DE 101 250564.0--

Signed and Sealed this

First Day of January, 2008

JON W. DUDAS
*Director of the United States Patent and Trademark Office*